United States Patent [19]

Peterman

[11] Patent Number: 4,523,794

[45] Date of Patent: Jun. 18, 1985

[54] LOCK FOR MANUAL MOBILE STORAGE SYSTEM

[75] Inventor: Robert J. Peterman, Cederburg, Wis.

[73] Assignee: Spacesaver Corporation, Fort Atkinson, Wis.

[21] Appl. No.: 514,114

[22] Filed: Jul. 15, 1983

[51] Int. Cl.[3] ..... A47B 87/00

[52] U.S. Cl. ..... 312/201; 70/210; 292/147; 312/200

[58] Field of Search ..... 312/198, 201; 292/106, 292/147, 150, 205; 70/85, 210

[56] References Cited

U.S. PATENT DOCUMENTS

| | | | |
|---|---|---|---|
| 826,607 | 7/1906 | Price | 292/150 |
| 3,085,300 | 4/1963 | Carlston | 292/150 X |
| 3,377,116 | 4/1968 | Dalbey | 70/85 |
| 3,877,261 | 4/1975 | Robins | 292/150 X |
| 3,934,908 | 1/1976 | Rifkin | 292/150 |
| 4,138,173 | 2/1979 | Taniwaki | 312/200 |

*Primary Examiner*—Francis K. Zugel
*Assistant Examiner*—Joseph Falk
*Attorney, Agent, or Firm*—Fuller, House & Hohenfeldt

[57] ABSTRACT

A locking device for a mobile filing and storage system comprises a reciprocable pin disposed in a rotatable handwheel. The pin is adapted to selectively engage or disengage locking apertures in a stationary plate mounted to the storage frame. The pin is formed with a pair of symmetrical frusto-conical surfaces having apexes that blend into concave surfaces that receive biasing means to retain the pin in the selected engaged or disengaged position against accidental reciprocation of the pin and to provide a tactile feel of proper location in and displacement from the engaged or disengaged position.

2 Claims, 6 Drawing Figures

LOCK FOR MANUAL MOBILE STORAGE SYSTEM

BACKGROUND OF THE INVENTION

1. Field of the Invention

This invention pertains to locking apparatus, and more particularly to apparatus for locking a mobile filing and storage unit in a predetermined position.

2. Description of the Prior Art

To obtain the maximum use of expensive building space, it is well known to employ mobile filing and storage systems. For example, mobile book shelves are commonly employed in libraries.

A common method of supporting mobile storage units includes wheels that roll on rails embedded in the building floor. The wheels are usually driven through a suitable mechanism by an electric motor or by a chain and sprocket and a manually operated handwheel located on the outside of the shelf.

Typically, mobile shelving units roll very freely. Even a slight and unintended force, such as caused by uneven rails or jarring, can cause a mobile shelf to start moving. Accidental start-up can be dangerous to a person caught between adjacent shelves and can damage the shelf and its contents if it strikes another object.

To prevent accidental start-up of a mobile shelf, a locking device is required. Locking devices can take several forms, but they usually are employed in conjunction with the manual handwheel. In one well-known design, a spring-loaded cam operated friction mechanism provides the locking force. However, friction devices do not provide positive locking. Further, the cam mechanism can wear with use, thus requiring either adjustment or replacement. In another form of locking device, a locking member is inserted between adjacent teeth of a tooth wheel that rotates with the handwheel. The latter design is exemplified by U.S. Pat. No. 4,138,173, wherein a knob protruding from a storage unit actuates, through an inclined plane arrangement, the locking member. Although that system may function satisfactorily, it requires a large number of parts, some of which are relatively expensive to manufacture. Moreover, the mere positioning of the knob does not indicate whether the locking member is properly engaged or disengaged.

Thus, a need exists for a simple, inexpensive, and long lasting mobile storage system locking apparatus that firmly locks the storage unit in place against unintended movement, and that signals the locked and unlocked conditions.

SUMMARY OF THE INVENTION

In accordance with the present invention, there is provided a long lasting and inexpensive positive locking mechanism for a mobile filing and storage system. This is accomplished by apparatus that includes a reciprocable pin mounted in a rotatable handwheel operatively connected to the storage system moving mechanism. The pin is adapted for selective engagement with cooperating pin receiving apertures in a stationary plate.

The pin is manually reciprocable to either of two positions. It may be pulled outwardly from the handwheel to the unlocked position and pushed inwardly to the locked position. In the outward unlocked position, the pin is retained only in the handwheel to rotate in unison therewith. In the locked position, the pin engages any of a plurality of close fitting apertures in the stationary plate, which is mounted rigidly to the storage unit frame, thus preventing rotation of the handwheel and, consequently, the storage unit moving mechanism.

Further in accordance with the present invention, the locking pin is provided with two symmetrical tapered surfaces. In the preferred embodiment, the locking pin is constructed with generally cylindrical ends, and a detent groove having two symmetrical frusto-conical surfaces is interposed therebetween. The bases of the frusto-conical surfaces terminate in a common cylindrical surface located at the center of the detent groove. The apex of each frusto-conical surface terminates in a concave curved surface that intersects a pin cylindrical surface.

To retain the pin in the desired position, whether locked or unlocked, and to signal the pin position, the tip of a spring-loaded plunger engages the pin detent groove. The plunger is mounted in the handwheel perpendicular to the longitudinal axis of the pin. Preferably, the spring biases the plunger toward the pin longitudinal axis. In both the locked and unlocked pin positions, the plunger tip engages the corresponding concave curved surface.

To enable the pin to be displaced from either the locked or unlocked position, the force of the plunger biasing spring must be overcome. This is accomplished by manually pushing or pulling the pin, as the case may be, so that the frusto-conical surface of the detent groove forces the plunger against the biasing spring. As the pin is displaced from an end position, the spring force on the pin increases, providing a tactile feel of such displacement to the operator. The spring force is a maximum when the pin is in contact with the cylindrical surface midway between the two frusto-conical surfaces, and minimum spring force occurs at the two end positions. The increased reaction force of the spring and plunger on the pin frusto-conical surfaces as the pin is moved from either position assures that the pin will move only when intended. Thus, the spring-loaded plunger retains the pin in the desired end position against accidental movement and signals that the pin is in the proper position. Further, this is accomplished with a minimum number of parts, and the parts are simple and inexpensive to manufacture.

Other objects and advantages of the invention will become apparent from the disclosure.

DETAILED DESCRIPTION OF THE INVENTION

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
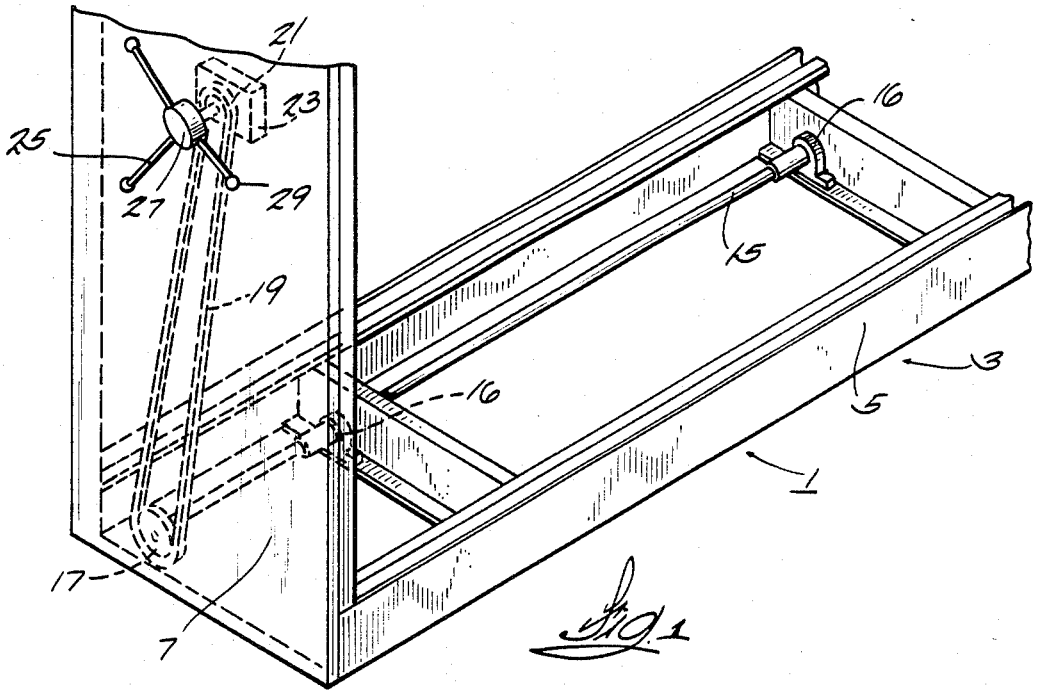
FIG. 1 is a partial perspective view of a mobile filing and storage system that incorporates the present invention.

Referring to FIG. 1, reference numeral 1 illustrates a mobile storage system that includes the present invention. The storage system finds particular usefulness in storing books in libraries and offices; however, it will be understood that the invention is not limited to book storing applications.

Figure 2:
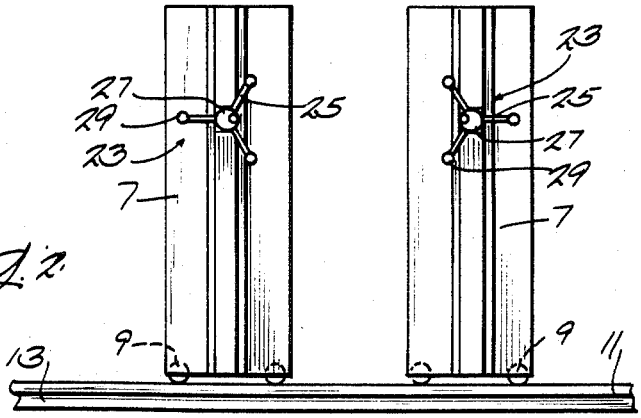
FIG. 2 is an end view of a pair of adjacent mobile storage shelves.

The storage system 1 includes a carriage assembly 3 composed of a generally horizontal lower frame 5 and a pair of upright side frames 7, only one of which is shown in FIG. 1. Extending between side frames 7 is a suitable storage structure, such as conventional book shelves, not shown. To allow easy movement of the carriage assembly, it is supported on a plurality of wheels 9 that ride on rails 11 embedded in the building floor 13, FIG. 2. The wheels 9 are supported in the frame 5 by suitable conventional bearings, not illustrated in FIGS. 1 and 2. The wheels are driven by drive means that form no part of the present invention. The drive means may include a shaft 15 supported in appropriate bearings 16. A sprocket 17 is mounted to one end of shaft 15. Chain 19 connects sprocket 17 with a second sprocket 21 that constitutes a component of a manual handwheel mechanism 23, FIGS. 1–4.

To permit movement of the carriage assembly with minimum effort, the handwheel mechanism 23 includes one or more spokes 25 that extend radially from a drive hub 27. The outer end of each spoke 25 may be provided with a knob 29. The drive hub 27 is joined to the shaft 31, as by screws 30, and rotates with the shaft 31 supported for rotation in bearings 33, 35, FIG. 4. Bearing 33 is mounted in a plate 37 which is rigidly fastened to the interior of channel portion 38 of side frame 7. Bearing 35 is mounted in an anti-roll plate 39 fastened to plate 37 with screws 41 which extend through channel 38. Shaft 31 supports sprocket 21 for driving chain 19. The shaft is restrained from axial shifting by conventional retaining rings 42.

In accordance with the present invention, the manual handwheel mechanism 23 is equipped with a pin type locking mechanism for locking the carriage assembly 3 in a predetermined location along rails 11 against accidental start-up. In the preferred embodiment, the locking mechanism comprises a generally cylindrical anti-roll pin 43 that is reciprocable within drive hub 27, FIGS. 4 and 5. To lock the handwheel hub 27 against rotation, the pin 43 is adapted to engage any of a plurality of locking apertures 49 arranged in a circle in anti-roll plate 39, FIGS. 3 and 4. To aid in engaging the locking apertures, the inner end of the pin may be formed with an external chamfer 51, FIGS. 4 and 5. The outer end of the pin may be manufactured with threads 45 to accept a knob 47, by which a person may easily push and pull the pin into or out of engagement with the locking apertures.

Figure 4:
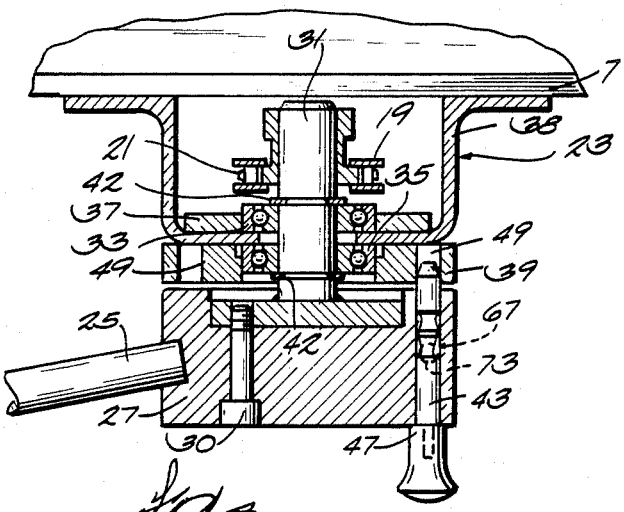
FIG. 4 is a sectional view taken along lines 4—4 of FIG. 3.
Figure 5:
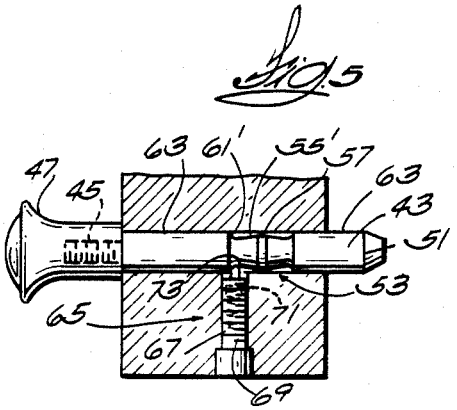
FIG. 5 is a sectional view taken along lines 5—5 of FIG. 3.
Figure 3:
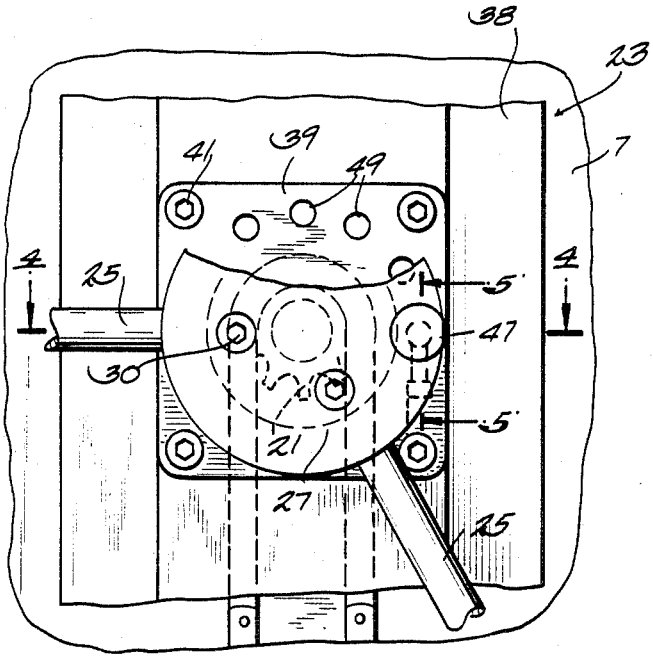
FIG. 3 is a partially broken end view of a mobile storage shelf handwheel mechanism that employs the present invention to lock the mobile shelf against accidental start-up.
Figure 6:
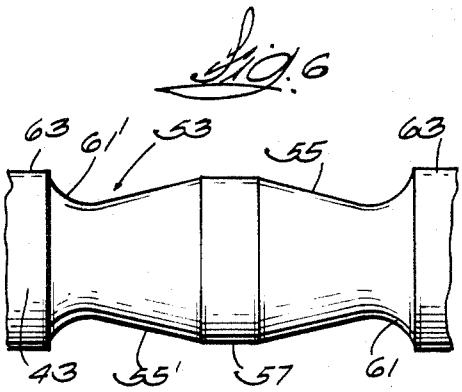
FIG. 6 is an enlarged view of the detent groove of the locking pin of the present invention.

Further in accordance with the present invention, the anti-roll pin 43 is manufactured with a detent groove 53, FIGS. 4–6. The detent groove is preferably formed as a pair of symmetrical frustoconical surfaces 55 and 55', the bases of which terminate in a common cylindrical surface 57. The apex end of the frusto-conical surfaces 55, 55' blend into concave curved surfaces 61, 61', respectively, that intersect the pin peripheral surface 63, preferably at right angles.

To retain the anti-roll pin 43 in the desired position, whether locked or unlocked, the invention employs biasing means for engaging the pin detent groove. In the illustrated embodiment, the biasing means comprises a spring-loaded plunger 65 having a hollow housing 67. A compression spring 69 is confined in the housing by a slideable plunger 71. The tip 73 of plunger 71 bears against the surface of the groove 53. The housing 67 may be threaded for insertion into corresponding threads in drive hub 27. Preferably, the plunger 71 is perpendicular to and is biased toward the longitudinal axis 72 of pin 43.

As best seen in FIG. 5, the plunger 71 is extended a maximum amount from housing 67 when the antiroll pin 43 is in either the outward unlocked position or the inward locked position. In those positions, the plunger bears against a surface 61 or 61', and the force exerted by compression spring 69 is a minimum. In order to displace the pin from an end position, the force of the spring must be overcome. This can be done by manually pushing or pulling the pin, using knob 47. The increasing reaction force of the spring against the pin provides a tactile feel to the operator that he is displacing the pin from an end position. Conversely, the minimum spring force upon reaching an end position provides tactile feedback that the pin is properly in an end position. Because of the springloaded plunger bearing against a surface 61 or 61', the pin cannot become displaced accidentally, as through building vibrations or by bumping the storage system.

In explaining the operation of the mobile filing and storage system 1 incorporating the illustrated embodiment of the present invention, it will be assumed the anti-roll pin 43 is initially in locking engagement with anti-roll plate 43. The operator manually pulls the knob 47 to the outward unlocked position. Because of the minimum biasing force of spring-loaded plunger 65 acting on the pin surface 61, the operator is assured the pin is in the unlocked position, and the pin will remain there until the knob is manually pushed inwardly. The operator then turns the spokes 25, thus moving the carriage 3 to the desired location along rails 11. At that point, the operator pushes the knob inwardly so that the pin enters an aperture 49 of plate 39. Because the minimum biasing force occurs when the spring-loaded plunger contacts circular surface 61', the operator can feel when the pin is in the proper locked position. The pin will remain in the locked position, thus preventing accidental start-up of the storage system, until the knob is again pulled for intentional movement.

It is apparent that there has been provided, in accordance with the invention, a locking device for a mobile filing and storage system that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. In combination with a mobile filing and storage system having frame means for storing material and adapted to move along a predetermined path; wheel means for supporting the frame means and for allowing easy movement thereof; drive means for driving the wheel means; and hub means mounted for rotation within the frame means about a hub axis for actuating the drive means, an improved apparatus for locking the system against movement comprising:

a. an anti-roll plate fixedly attached to the frame means, the plate having at least one locking aperature therein;

b. a generally cylindrical pin having a longitudinal axis generally parallel to the hub axis disposed for manual reciprocation in the hub means, the pin being selectively positionable between partial insertion into the anti-roll plate locking aperature for locking engagement therewith and complete withdrawal from the antiroll plate locking aperature for unlocking disengagement therefrom, the pin having a plurality of circumferential grooves intermediate the ends thereof, the grooves being formed as a pair of symmetrical frusto-conical surfaces having common bases; and c. biasing means disposed in the hub means for bearing against the pin frusto-conical surfaces to retain the pin in the selected position and to provide a gradually increasing and subsequent decreasing resistance to pin reciprocation, thereby creating a tactile feel of pin displacement between the engaged and disengaged positions.

2. The combination of claim 1 wherein the apexes of the frusto-conical surfaces terminate tangentially in concave curved surfaces which intersect the pin cylindrical surfaces at right angles, and wherein the biasing means includes a plunger having a tip with a radius substantially equal to the radius of the concave curved surfaces for bearing against a corresponding curved surface when the pin is in the selected position to prevent further movement of the pin.

* * * * *